US009620324B2

(12) United States Patent
Golden et al.

(10) Patent No.: US 9,620,324 B2
(45) Date of Patent: Apr. 11, 2017

(54) X-RAY TUBE

(71) Applicants: Phillip Golden, Greens Fork, IN (US); Scott A. Watson, Jemez Springs, NM (US); Timothy Knowles, Del Mar, CA (US)

(72) Inventors: Phillip Golden, Greens Fork, IN (US); Scott A. Watson, Jemez Springs, NM (US); Timothy Knowles, Del Mar, CA (US)

(73) Assignees: Golden Engineering, Inc., Centerville, IN (US); Los Alamos National Security, LLC, Los Alamos, NM (US)

( * ) Notice: Subject to any disclaimer, the term of this patent is extended or adjusted under 35 U.S.C. 154(b) by 142 days.

(21) Appl. No.: 14/181,278

(22) Filed: Feb. 14, 2014

(65) Prior Publication Data

US 2014/0226791 A1 Aug. 14, 2014

Related U.S. Application Data

(60) Provisional application No. 61/764,996, filed on Feb. 14, 2013.

(51) Int. Cl.
*H01J 35/06* (2006.01)
*H01J 35/32* (2006.01)

(52) U.S. Cl.
CPC ..... *H01J 35/06* (2013.01); *H01J 35/32* (2013.01); *H01J 2235/062* (2013.01); *H01J 2235/087* (2013.01)

(58) Field of Classification Search
CPC ..... H01J 35/00; H01J 35/06; H01J 35/065; H01J 35/08; H01J 35/32; H01J 2235/062; H01J 2235/087; G01N 23/04
USPC ..... 378/121, 122, 136, 143
See application file for complete search history.

(56) References Cited

U.S. PATENT DOCUMENTS 1,912,919 A 6/1933 Rylsky
3,280,356 A * 10/1966 Stoudenheimer ..... H01J 31/501 250/214 VT
3,397,337 A 8/1968 Denholm
3,883,760 A * 5/1975 Cunningham, Jr. .... H01J 35/22 313/309
3,992,633 A * 11/1976 Braun et al. ..... 378/2
4,104,532 A * 8/1978 Weiss ..... 378/38
4,439,870 A * 3/1984 Poulsen ..... H01J 35/08 378/130
4,455,504 A * 6/1984 Iversen ..... H01J 35/106 313/30
5,442,677 A * 8/1995 Golden et al. ..... 378/102
6,020,677 A 2/2000 Blanchet-Fincher et al.
(Continued)

OTHER PUBLICATIONS

Mesyats, G.A., Pulsed Power, 2005, Springer Science+Business Media, Inc (New York, NY), pp. 469-73.
(Continued)

*Primary Examiner* — Robert Kim
*Assistant Examiner* — David E Smith
(74) *Attorney, Agent, or Firm* — Benesch Friedlander Coplan Aronoff, LLP; Benjamin E. Kern; Thomas Y. Kendrick

(57) ABSTRACT

A sealed cold cathode X-ray tube for use in small X-ray source devices is provided. In one embodiment, a sealed cold cathode X-ray tube includes an elongate member, a cathode emitter, and an anode.

19 Claims, 4 Drawing Sheets

(56) References Cited

U.S. PATENT DOCUMENTS

| | | | | |
|---|---|---|---|---|
| 6,134,300 | A * | 10/2000 | Trebes et al. | 378/136 |
| 7,809,115 | B2 | 10/2010 | Allen et al. | |
| 7,965,818 | B2 * | 6/2011 | Jaafar et al. | 378/122 |
| 8,090,075 | B2 * | 1/2012 | Holm | H01J 35/12 378/141 |
| 2002/0175609 | A1 * | 11/2002 | Shiffler, Jr. | H01J 1/304 313/311 |
| 2011/0150184 | A1 * | 6/2011 | Kozaczek | H01J 35/06 378/138 |
| 2012/0027177 | A1 * | 2/2012 | Ogata et al. | 378/95 |

OTHER PUBLICATIONS

X-Ray Tubes: IMA Line X-ray tubes Emitters Ruselectronics. 2006. <http://catalogue.roselgroup.ru/eng/emitters/x-ray/5/default.htm> Last accessed on Feb. 2, 2014.

International Search Report and Written Opinion for related PCT Application No. PCT/US2014/016555, dated May 27, 2014.

* cited by examiner

X-RAY TUBE

CROSS-REFERENCE TO RELATED APPLICATIONS

This application claims priority from U.S. Provisional Patent Application No. 61/764,996, filed on Feb. 14, 2013, which is incorporated by reference herein in its entirety.

STATEMENT REGARDING FEDERAL RIGHTS

The United States government has rights in this invention pursuant to Contract No. DE-AC52-06NA25396 between the United States Department of Energy and Los Alamos National Security, LLC for the operation of Los Alamos National Laboratory.

BACKGROUND

X-ray technology for some applications, such as detection of explosives and other industrial radiography, requires a relatively small X-ray source device that is easily portable. Although small X-ray source devices are useful, they sometimes lack sufficient capability. In some situations, achieving a required energy level to perform certain X-ray applications using a conventional small X-ray source is not possible. What is needed is an X-ray tube for use in a small X-ray source device capable of operating at higher energy levels.

SUMMARY

In one embodiment, a sealed cold cathode X-ray tube for use in small X-ray source devices is provided, the sealed cold cathode X-ray tube for use in small X-ray devices comprising: a tube body having two ends and at least one side extending axially between the two ends; a cathode emitter positioned on a central axis of the tube body, the cathode emitter being spaced from the two ends and the side of the tube body; and an anode spaced from the cathode emitter along the central axis of the tube body and positioned at one of the two ends of the tube body, wherein the anode defines a solid end surface of the X-ray tube for promoting X-ray travel through the solid end surface.

In another embodiment, a sealed cold cathode X-ray tube for use in small X-ray source devices is provided, the sealed cold cathode X-ray tube for use in small X-ray devices comprising: a cathode emitter positioned on an axis aligned with an intended direction of X-ray travel; and an anode positioned coaxially with, and axially spaced downstream in the intended direction of X-ray travel from the cathode emitter, the anode defining a solid end surface of the X-ray tube for promoting X-ray travel through the end surface.

In one embodiment, a sealed cold cathode X-ray tube for use in small X-ray devices has approximately a same external geometry of conventional X-ray tubes, thus allowing a sealed cold cathode X-ray tube to be substituted for a conventional X-ray tube (provided that a sealed cold cathode tube's reversed polarity is addressed).

In another embodiment, a sealed cold cathode X-ray tube for use in small X-ray devices is designed to have approximately a same current load or impedance as a conventional X-ray tube.

In another embodiment, a sealed cold cathode X-ray tube for use in small X-ray devices has a cost-effective construction and is designed for a robust life of use.

In another embodiment, a sealed cold cathode X-ray tube for use in small X-ray devices may be a space charge limited, cold-cathode, Pierce geometry type in a sealed tube with an explosive type emitter, such as a Fowler-Nordheim type, exhibiting low outgassing and high current density.

BRIEF DESCRIPTION OF THE DRAWINGS

The accompanying figures, which are incorporated in and constitute a part of the specification, illustrate various example systems and methods, and are used merely to illustrate various example embodiments.

DETAILED DESCRIPTION

Figure 1:
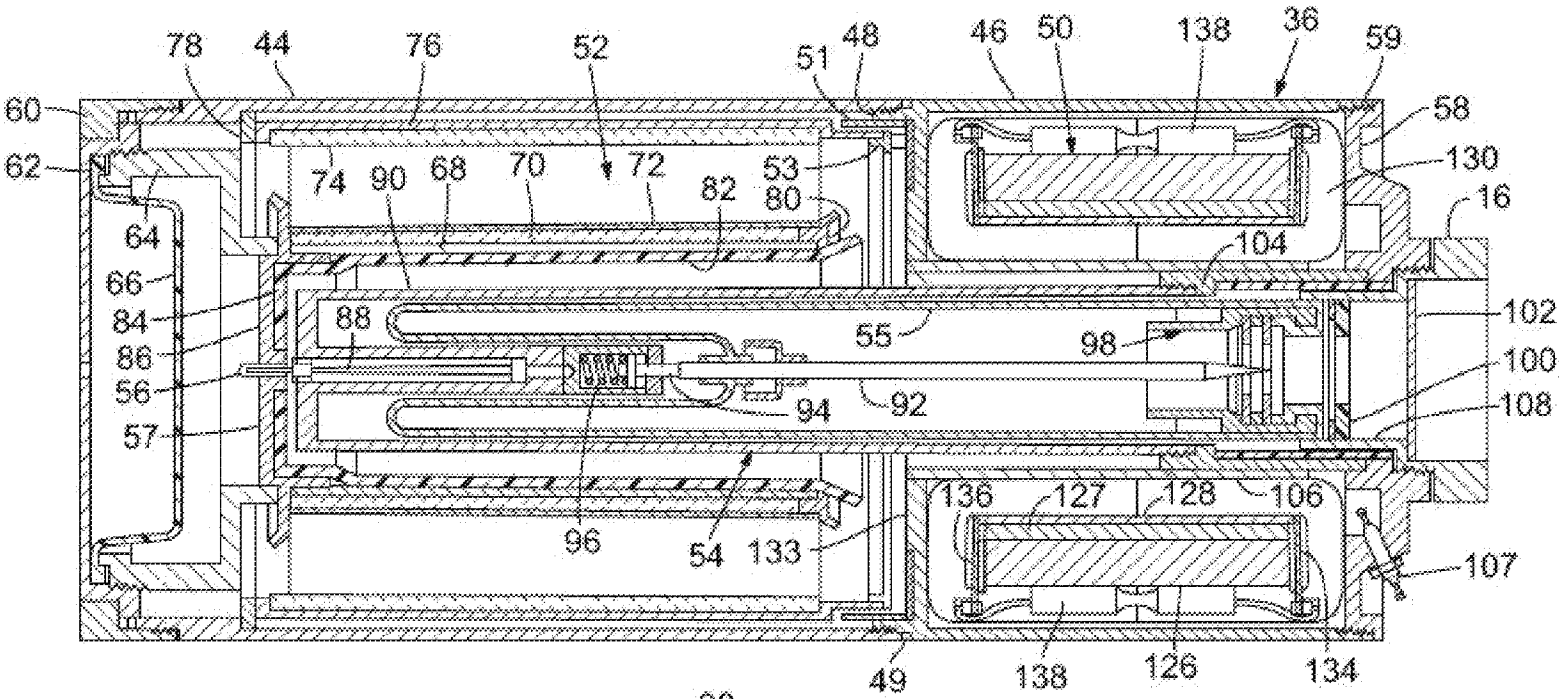
FIG. 1 Prior Art
FIG. 1 illustrates a cross section of a conventional X-ray source device having a conventional X-ray tube.

FIG. 1 illustrates a cross-section of a conventional small, low power, pulsed output, portable X-ray source device, and specifically a cylindrical canister 36 containing principal electronic parts including a high-voltage generator, a high-voltage transformer, and a conventional sealed X-ray tube 54. At a right end of the canister 36, there is an X-ray tube housing cap 16 through which X-rays are directed toward an object during operation of the device.

As shown in FIG. 1, canister 36 comprises hollow, cylindrical sections 44 and 46. Section 46 is provided with a threaded interior collar 48 to engage an internally threaded portion of the section 44 so that both sections 44 and 46 may be screwed together and apart as desired. An O-ring seal 49 is disposed between sections 44 and 46, such that an entire interior of the canister 36 may be evacuated and filled with oil and sealed.

Joining canister sections 44 and 46 serves to make an electrical connection between a high-voltage, transformer output unit 50 and a spiral capacitor 52 which operates as a high-voltage generator. Both transformer output unit 50 and the spiral capacitor 52 are disposed within sealed canister 36, with transformer output unit 50 within cylindrical section 46, and spiral capacitor 52 being within cylindrical section 44. To make a high voltage connection between transformer output unit 50 and spiral capacitor 52, transformer output unit 50 has an annular high-voltage contact 51, which engages a ring 53 on spiral capacitor 52 when canister sections 44 and 46 are fully screwed together. Ring 53 is electrically connected to a high-voltage plate of spiral capacitor 52 for charging spiral capacitor 52.

Transformer output unit 50 and spiral capacitor 52 are disposed within canister 36 in coaxial, but axially spaced relationship, and are both of such a configuration as to provide a continuous, hollow interior volume within which is disposed an elongated, cylindrical X-ray tube 54 having a reentry-type glass envelope 55. X-ray tube 54 receives a high voltage contact 56, which is disposed through a corona suppressor member 57 and is connected to high voltage plate of the spiral capacitor 52.

Canister section 46 is shown terminating in an annular end plate 58, which is threadedly engaged with tube housing cap 16. In addition, an O-ring seal 59 is disposed between threadedly engaged portions of canister section 46 and end plate 58 to maintain an oil seal as described above. Canister 36 is provided with an external retainer ring 60 which threadedly engages canister portion 36 and a rear cover plate 62 which, together with a high-voltage cantilever support member 64, holds in place a resilient diaphragm 66 to accommodate expansion and contraction of oil within canister 36 with varying temperature conditions, allowing the interior of canister 36 to be evacuated before use, such that no air bubbles remain trapped in the oil. Diaphragm 66, thus, operates like a bellows to accommodate a varying volume of oil in a presence of temperature changes.

Spiral capacitor 52 comprises a metallic mounting cylinder 68 upon which is disposed a plurality of circumferentially spaced inner ferrite strips 70 and a plastic or other dielectric cylindrical form 72 upon which are wound in parallel, interleaved fashion two mutually insulated copper foil strips separated from one another by layers of Mylar and paper. Copper foil strips are each approximately 2.5 inches in width by 30 feet in length and are wrapped up upon one another to form a pair of spaced parallel capacitor plates having a large number of turns. Connection between high voltage foil of spiral capacitor 52 and high voltage contact 56 for X-ray tube 54 is made by bringing foil through a slot in plastic coil form 72 and running a conductive copper strip between form 72 and ferrite strip 70 to an aluminum ring 80. Ring 80 is in contact with cylinder 68 and an end plate 86, both of which are conductive. By having cylinder 68 at a same voltage as capacitor foil, corona discharge in this area is suppressed. A second plurality of spaced ferrite strips 74 are disposed around an outside of the capacitor 52, and a retaining cylinder 76 of plastic or other suitable dielectric material is disposed therearound to maintain a ferrite in place. Ferrite strips 70 and 74 substantially increase an output of spiral capacitor 52. A positioning ring 78 is disposed between an internal shoulder on canister section 44 and spiral capacitor 52 to maintain spiral capacitor 52 in a proper axial position within canister 36.

For corona suppression, a metallic corona shield ring 80 having a radially flared configuration illustrated is disposed around an interior of spiral capacitor 52 on an end thereof, and, as previously mentioned, is maintained at a high voltage by connection to capacitor foil. Corona shield ring 80 abuts ferrite strips 70 on an internal diameter of capacitor plate winding arrangement, and bears against a cylindrical lead shield 82 which lies between spiral capacitor 52 and X-ray tube 54. Cylindrical lead shield 82 extends a full length of X-ray tube 54 and terminates adjacent to annular shield portion 84. Corona suppressor member 57 further includes a metallic end plate 86 disposed on a side of capacitor 52, and may have a flared configuration. Metallic end plate 86 is threadedly engaged with cantilevered high-voltage support ring 64.

With reference to an interior of conventional sealed X-ray tube 54, high-voltage contact 56 in corona suppressor 86 engages a high-voltage contact rod 88 which is disposed within a plastic tube housing 90 so as to make contact with an end of a tungsten anode 92 by way of a contact plunger 94 and a contact spring 96 within a reentry portion of X-ray tube envelope 55. Anode 92 is an elongated and pointed structure and cooperates with a cathode assembly 98 to produce X-ray output pulses upon an application of a high-voltage pulse sequence to anode 92 by way of high-voltage contact 56. These X-ray pulses are directed through lead collimator washer 100 and the fiberglass window 102 to an object under examination by way of tube housing cap 16.

Tube housing 90 is threadedly engaged at an end with a retainer collar 104, which, in turn, is fixed to annular end plate 58 so as to engage a cylindrical lead transformer shield 106. Shield 106 is disposed within an interior volume of transformer output unit 50. A lead shield ring 108 of cylindrical configuration is also disposed around a cylindrical path through which an X-ray beam travels on route to an object being examined for protection of transformer unit 50. A plurality of feed-through terminal plugs 107 are disposed in annular end plate 58 to bring leads from the transformer unit 50 to external devices.

Figure 2:
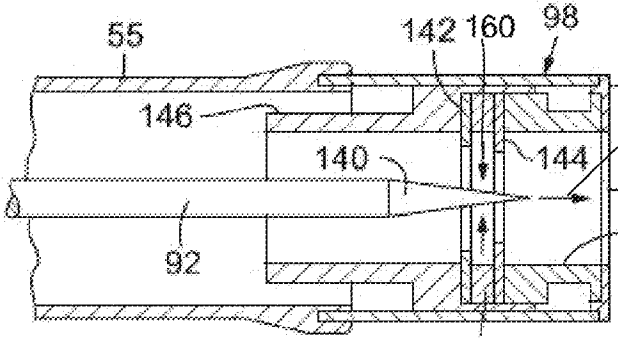
FIG. 2 Prior Art
FIG. 2 illustrates an enlarged cross-section of a portion of a conventional X-ray tube and shows an anode and cathode assembly.

Referring now to FIG. 2, pointed tungsten anode 92 has a tapered portion 140 about which are spaced woven graphite fabric cathode rings 142 and 144. Rings 142 and 144 are held in place by means of an internally stepped cathode support tube 146 having a radial interior shoulder, a press fit spacer or separator 148, and a cathode clamp ring 150, which is also press fit within cathode support tube 146. A nickel window 152 is held in place adjacent an end of the assembly 98 between the cathode clamp ring 150 and end ring 154. Woven graphite fabric cathode rings 142 and 144 are provided with interior diameters that vary as between two rings so as to maintain a substantially uniform spacing between an outer surface of the tapered portion 140 of anode 92 and an interior diameter of cathode rings 142 and 144.

Referring to FIG. 2, arrows 160 indicate a direction of a flow of electrons, which is generally a radial direction from cathode rings 142, 144 towards a tapered portion 140 of the anode 92, and is approximately perpendicular to an intended direction along which X-rays are emitted, which is in axial direction as indicated by the arrows 162. Use of annular knife-edge cathodes such as the cathode rings 142, 144 with an electron flow orthogonal to an intended direction of radiation flow has disadvantages, especially as electron energy increases. As electron energy approaches a rest mass (511 keV), a resulting X-ray production is increasingly forward-biased in a direction of electron flow (with an angular distribution angle that falls like 1/y where y is a relativistic mass factor).

In conventional X-ray tube 54, as electron energy increases, more photons are being directed radially towards the side of conventional X-ray tube 54 tube than axially. As a result, a conventional X-ray tube 54 becomes less effective as electron energy is increased.

A sealed cold cathode X-ray tube 200 for use in small X-ray devices is illustrated in FIGS. 3-9. Sealed cold cathode X-ray tube 200 may effectively produce X-rays at much greater electron energy levels than conventional X-ray tubes.

Similar to conventional X-ray tubes, sealed cold cathode X-ray tube 200 may be a cold cathode type (and, thus, does not require power like a hot cathode, "Coolidge" type), and, like a Coolidge tube, may be provided in a sealed tube configuration. In contrast to conventional X-ray tubes, however, sealed cold cathode X-ray tube 200 may have a "Pierce" tube-type geometry in which electrons flow along a same direction as an intended direction of photon flow. This geometry may also be referred to as a forward-directed geometry because electrons may continue to move in a same forward direction as photons, even as electron energy rises.

Conventional cold cathode X-ray tubes tend not to emit well because they operate at room temperature and no free electrons are created on a cathode surface. In one embodiment, a sealed cold cathode X-ray tube 200 for use in small X-ray devices has an improved emitter material and geometry to provide satisfactory emitter performance over an expected target range of operation.

In one embodiment, sealed cold cathode X-ray tube 200 has a same external geometry as conventional X-ray tube 54. In another embodiment, sealed cold cathode X-ray tube 200 also has a same current load or impedance as an annular diode. In this embodiment, sealed cold cathode X-ray tube 200 may be substituted for conventional X-ray tube 54 in a conventional X-ray source device illustrated in FIGS. 1 and 2, provided that changes are made to accommodate a reversed polarity of sealed cold cathode X-ray tube 200. Sealed cold cathode X-ray tube 200 may be most effective when submerged in an insulator/coolant such as oil.

Figure 3:
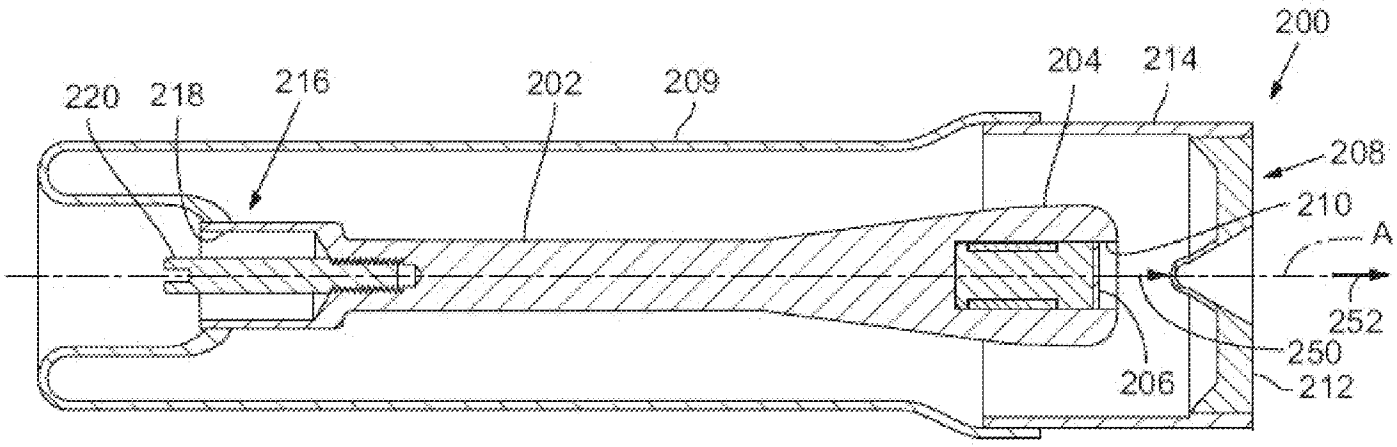
FIG. 3 illustrates a cross section of a cold cathode X-ray tube.

With reference to FIG. 3, sealed cold cathode X-ray tube 200 may have an emitter 206 positioned on a central axis A of sealed cold cathode X-ray tube 200, and an anode 208 may be spaced from emitter 206 in the axial direction and forms an end of cold cathode X-ray tube 200. In one embodiment, cold cathode X-ray tube 200 has an elongate member 202 with a free end 204 to position the emitter 206 as illustrated. Member 202 may be mirror polished to reduce breakdown.

Anode 208 may be received within a hollow tubular portion 214, which may, in turn, be joined to a cylindrical glass envelope 209. In one embodiment, an area of a junction between glass envelope 209 and hollow tubular portion 214 is protected from arcing by adding a flange to hollow tubular portion 214 that follows the inner contour of glass envelope 209.

As illustrated in FIG. 3, glass envelope 209 generally surrounds an axial member 202 and supports a fixed end 216 of axial member 202 along axis A. Fixed end 216 may have a recess 218 within which a pin 220 extends along axis A.

Figure 4:
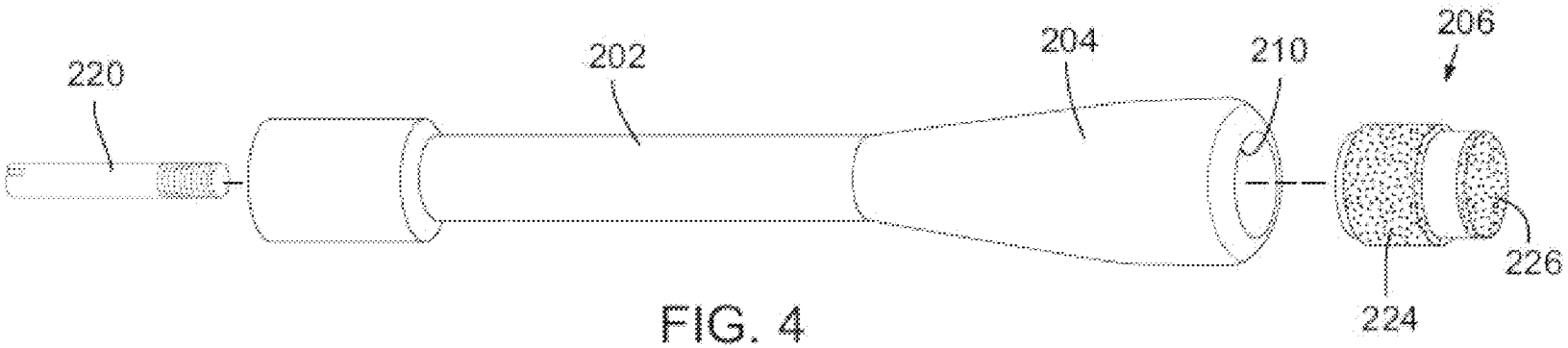
FIG. 4 illustrates an exploded perspective view of an elongate member of a cold cathode X-ray tube.
Figure 9:
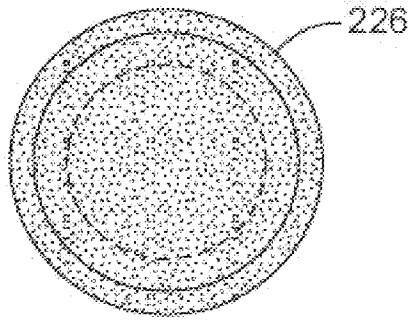
FIG. 9 illustrates enlarged end views of an emitter.
Figure 8:
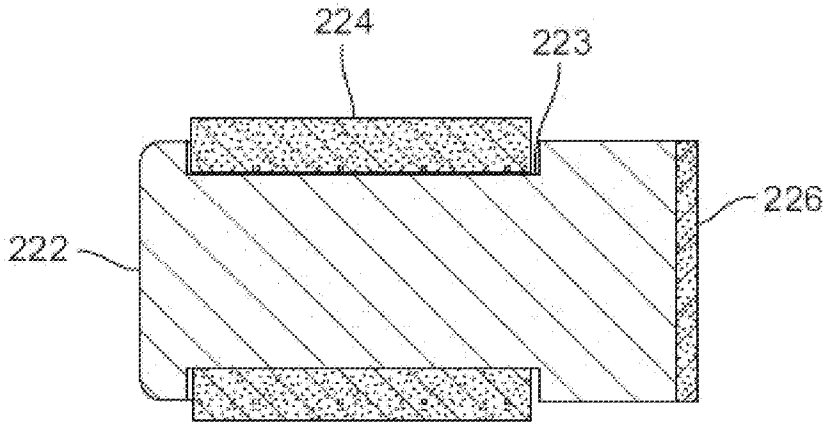
FIG. 8 illustrates an enlarged section view of an emitter.

With reference to FIGS. 4, 8, and 9, in one embodiment, free end 204 is smoothly shaped and has a recess 210 defined along axis A and is shaped to receive emitter 206. Emitter 206 may have an end surface 226 that may include carbon fiber material selected such that fibers are oriented axially.

Figure 6:
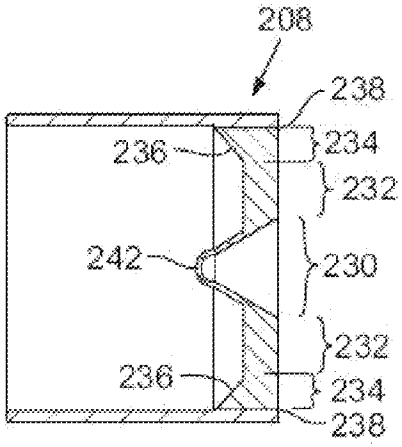
FIG. 6 illustrates an enlarged section view of an anode of a cold cathode X-ray tube.
Figure 7:
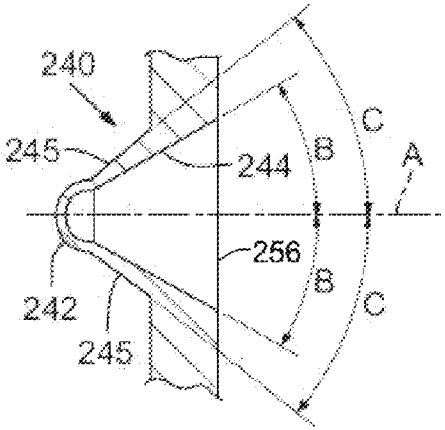
FIG. 7 illustrates an enlarged view of a portion of an anode showing a cone-like shape.
Figure 5:
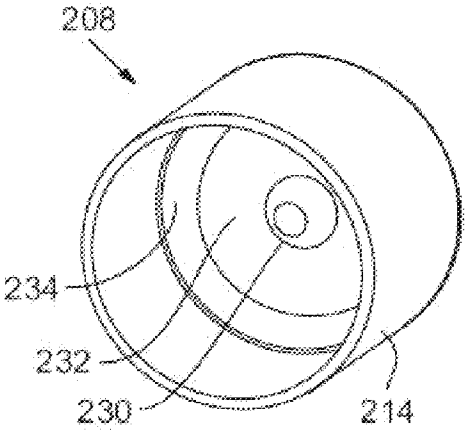
FIG. 5 illustrates a perspective view of an anode of a cold cathode X-ray tube.

With reference to FIGS. 6 and 7, anode 208 may have a shaped outer end 212 formed with a cone-like shape 240. With reference to FIGS. 5 and 6, anode 208 may have a center portion 230 centered on axis A, a surrounding, intermediate, disk-shaped portion 232, and an outer edge portion 234 with an angled surface 236 adjacent to hollow tubular portion 214. In one embodiment, there is a joint 238 between anode 208 and hollow tubular portion 214. FIG. 5 illustrates a perspective view of inner surfaces of hollow tubular portion 214 and the anode 208.

A cone-like shape 240 may have an angled side surface 244 extending from an outer side and, instead of a pointed tip of a regular cone, cone-like shape 240 may have an adjoining rounded center 242. In one embodiment, angled outer side surface 244 defines an angle of about 20 degrees relative to axis A, and an angled inner side 245 defines an angle of about 38 degrees relative to axis A.

Referring to FIG. 7, anode 208 may be formed of tungsten, which is somewhat porous. A nickel window 256 or other similar structure that tends to prevent cold cathode X-ray tube 200 from exhibiting a vacuum leak may be provided. Nickel window 256 may be positioned directly over an outer end of anode 208. A small hole (not shown) may be provided in cone-like shape 240 to allow a vacuum to be drawn down.

With reference to FIG. 3, arrows 250 and 252 illustrate a direction of a flow of electrons 250 and emitted X-rays 252 in cold cathode X-ray tube 200 respectively. In one embodiment, an alignment of a flow of electrons 250 with emitted X-rays 252 lead to an increased efficiency whenever an electron energy approaches a rest mass (511 keV)—that is, at higher electron levels, such as electron levels greater than 250 keV, photons are still directed axially in cold cathode X-ray tube 200.

With reference to FIGS. 4, 8, and 9, emitter 206 may be shaped as a cylinder 222 with outer end surface 226 and a side portion 224. Outer end surface 226 and side portion 224 may each formed of a suitable material, such as carbon velvet. Outer end surface 226, sometimes referred to as a "button," may include carbon fibers that are sufficient in density and axial orientation to support the high current application.

Carbon fibers of side portion 224 may form a high-conductivity contact between recess 210 of member 202 and end surface 226, through cylinder 222. In one embodiment, cylinder 222 is formed of graphite. Fibers of side portion 224 may be dimensioned to assist in retaining cylinder 222 within recess 210 of member 202 (which may be formed of stainless steel). For example, fibers of side portion 224 may protrude beyond an outer diameter of cylinder 222 such that urging cylinder 222 into recess 210 causes fibers of side portion 224 to be bent toward end surface 226. In this example, some fibers may tend to contact and engage with recess 210, thereby becoming like barbs that may tend to resist a withdrawal of cylinder 222 from recess 210 in an axial direction. Such an engagement may be beneficial, because a sufficient holding force may be generated, which may eliminate disadvantages associated with a conventional securing approach. Narrow passages that may plague a conventional approach of securing a wad of carbon fiber in place with a screw, including difficulties associated with evacuating constricted areas (such as where mating screw threads meet) when a vacuum is being established, may be lessened by use of protruding fibers.

Cylinder 222 may be formed with an inset 223 on its side surface to accommodate a positioning of fibers of side portion 224. In one embodiment, instead of a flat end surface 226, end surface 226 may be a dished end surface or an end surface 226 of another shape.

In one embodiment, carbon velvet material is secured to the graphite cylinder 222 with epoxy, which is then heated to a high temperature (such as about 1500K) in a presence of a hydrocarbon gas to effect a carbon vapor infiltration process and create an electrically and thermally conductive unit having high current emission and long life.

Figure 10:
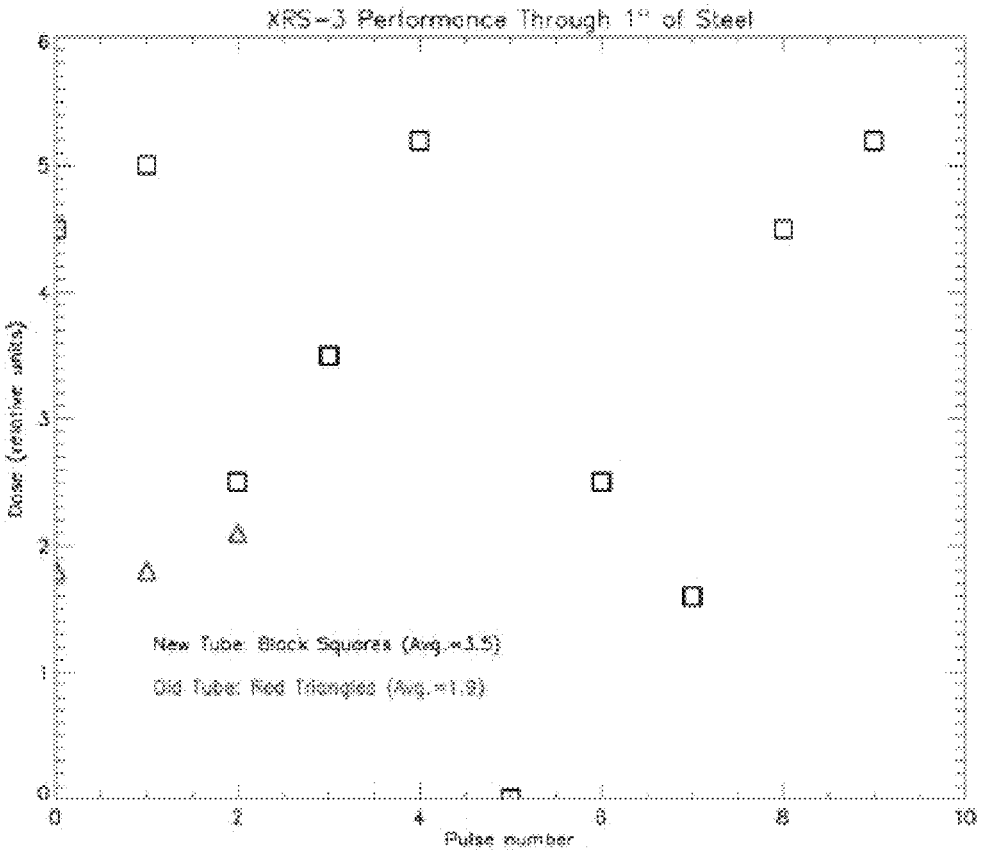
FIG. 10 illustrates a graph of X-ray source device performance comparing detection through a thick steel section using a conventional X-ray tube versus a cold cathode X-ray tube for use in small X-ray devices.

With reference to FIG. 10, a graph of the dose versus test number for radiation detected through a thick object (1" steel section) with both conventional X-ray tube and a cold cathode X-ray tube 200 is illustrated. As indicated by "new tube" data points (squares), an average dose may be 3.5 for detections with cold cathode X-ray tube 200, which is more than twice an average dose of 1.9 for detections with a conventional X-ray tube 54 ("old tube") data points (triangles). A harder, high-energy spectrum of cold cathode X-ray tube 200 with its forward-directed geometry results in greater penetration and therefore a higher dose. In addition, cold cathode X-ray tube 220 design has proven to be robust, as it has been fired over 25,000 times without substantial breakdown or loss of emission.

What is claimed is:

1. A sealed cold cathode X-ray tube for use in small X-ray source devices, comprising:

a tube body having two ends and at least one side extending axially between the two ends;

a cathode emitter positioned on a central axis of the tube body, the cathode emitter being spaced from the two ends and the side of the tube body; and an anode spaced from the cathode emitter along the central axis of the tube body and positioned at one of the two ends of the tube body, wherein the anode defines a solid end surface of the X-ray tube for promoting X-ray travel through the solid end surface, the anode having:

a center portion having a cone-like shape with a base of the cone-like shape oriented away from the cathode emitter;

an intermediate disk-shaped portion surrounding the center portion; and an outer edge portion surrounding the intermediate disk-shaped portion, wherein the outer edge portion increases in thickness as a distance from the central axis of the tube body increases.

2. The sealed cold cathode X-ray tube of claim 1, wherein the sealed cold cathode X-ray tube has a forward-directed geometry in which the cathode emitter and the anode are aligned along an intended direction of X-ray travel to produce a flow of electrons aligned in the intended direction of X-ray travel at energies approaching or exceeding an electron mass.

3. The sealed cold cathode X-ray tube of claim 1, wherein the anode is formed of a heavy metal.

4. The sealed cold cathode X-ray tube of claim 1, wherein the cathode emitter is positioned within a recess on an end of a member suspended within the tube body.

5. The sealed cold cathode X-ray tube of claim 1, wherein the cathode emitter comprises a carbon velvet material.

6. The sealed cold cathode X-ray tube of claim 1, wherein the cathode emitter comprises a carbon-velvet material in curved and flat shapes deposited on a graphite substrate.

7. The sealed cold cathode X-ray tube of claim 4, wherein the cathode emitter comprises a carbon velvet material deposited on side and exposed end surfaces of a graphite cylinder dimensioned to be received in the recess.

8. The sealed cold cathode X-ray tube of claim 7, wherein the carbon velvet material on the side surface of the cylinder is distinct and separate from the carbon velvet material on the exposed end surface of the graphite cylinder.

9. The sealed cold cathode X-ray tube of claim 4, wherein a free end of the member is mirror polished to reduce breakdown.

10. The sealed cold cathode X-ray tube of claim 1, wherein the anode has a center portion that is thinner in an axial direction than a surrounding intermediate portion.

11. The sealed cold cathode X-ray tube of claim 10, wherein the anode has an outer edge portion surrounding the surrounding intermediate portion, and wherein the surrounding intermediate portion is thinner in the axial direction than the outer edge section.

12. The sealed cold cathode X-ray tube of claim 1, further comprising a hollow tubular portion surrounding the outer edge portion and extending toward the cathode emitter, wherein the hollow tubular portion is formed of kovar, and wherein the center portion, intermediate disk-shaped portion, and outer edge portion are formed as a single piece from a heavy metal alloy.

13. The sealed cold cathode X-ray tube of claim 1, wherein the center portion has a rounded or pointed center corresponding to a tip of the cone-like shape.

14. The sealed cold cathode X-ray tube of claim 1, wherein the center portion has a rounded center, and the rounded center is joined to an angled side surface corresponding to a side surface of the cone-like shape.

15. The sealed cold cathode X-ray tube of claim 1, wherein an inner surface of the outer edge portion is angled at approximately 45 degrees relative to the central axis of the tube body.

16. The sealed cold cathode X-ray tube of claim 12, further comprising an elongate member extending axially and supporting the cathode emitter within the tube body, wherein the tube body forms at least a portion of a glass envelope extending from the hollow tubular portion to an opposite one of the two ends of the tube body, the glass envelope supporting a fixed end of the elongate member.

17. The sealed cold cathode X-ray tube of claim 1, wherein at least a portion of the anode is covered with a metal sufficient to prevent leaking so as to maintain a vacuum within the tube body.

18. A sealed cold cathode X-ray tube for use in small X-ray source devices, comprising:

a cathode emitter positioned on an axis aligned with an intended direction of X-ray travel; and an anode positioned coaxially with, and axially spaced downstream in the intended direction of X-ray travel from the cathode emitter, the anode defining a solid end surface of the X-ray tube for promoting X-ray travel through the end surface, the anode having:

a center portion having a cone-like shape with a base of the cone-like shape oriented away from the cathode emitter;

an intermediate disk-shaped portion surrounding the center portion; and an outer edge portion surrounding the intermediate disk-shaped portion, wherein the outer edge portion increases in thickness as a distance from the central axis of the tube body increases.

19. A sealed cold cathode X-ray tube for use in small X-ray source devices, comprising:

a tube body having two ends and at least one side extending axially between the two ends;

a graphite cylinder cathode emitter having a side surface and end surfaces with a carbon velvet material deposited on the side surface and an exposed end surface, the cathode emitter being spaced from the two ends and the side of the tube body, and positioned on a central axis of the tube body within a recess on an end of a member suspended within the tube body, wherein the carbon velvet material on the side surface of the emitter is distinct and separate from the carbon velvet material on the exposed end surface of the emitter; and an anode spaced from the cathode emitter along the central axis of the tube body and positioned at one of the two ends of the tube body, wherein the anode defines a solid end surface of the X-ray tube for promoting X-ray travel through the solid end surface.

* * * * *